US005803042A

United States Patent [19]

Bortone

[11] Patent Number: 5,803,042

[45] **Date of Patent: *Sep. 8, 1998**

[54] VALVES AND VALVE TIMING FOR INTERNAL COMBUSTION ENGINE

[76] Inventor: Cesare Bortone, Via Antonello Conlgor 14 Apt 1901, Lecce, Italy, 73100

[ * ] Notice: The terminal 14 months of this patent has been disclaimed.

[21] Appl. No.: 374,688

[22] PCT Filed: Jul. 27, 1993

[86] PCT No.: PCT/US93/06952

§ 371 Date: Jan. 24, 1995

§ 102(e) Date: Jan. 24, 1995

[87] PCT Pub. No.: WO94/02717

PCT Pub. Date: Feb. 3, 1994

[30] Foreign Application Priority Data

Jul. 27, 1992 [IT] Italy ..... BA92A0023

[51] Int. Cl.[6] ..... F01L 3/20

[52] U.S. Cl. ..... 123/312; 123/79 C; 123/188.4; 123/188.5; 251/325

[58] Field of Search ..... 123/188.1, 188.3, 123/188.4, 188.5, 79 C, 312; 251/325; 137/625.35

[56] References Cited

U.S. PATENT DOCUMENTS

| | | |
|---|---|---|
| 1,757,907 | 5/1930 | Jameson et al. . |
| 2,882,886 | 4/1959 | Butcher, Jr. . |
| 2,937,631 | 5/1960 | Coyle . |
| 3,881,459 | 5/1975 | Gaetcke . |
| 4,106,439 | 8/1978 | Kanao . |
| 4,503,817 | 3/1985 | Klomp et al. . |
| 4,836,154 | 6/1989 | Bergeron . |
| 4,901,683 | 2/1990 | Huff . |
| 5,054,438 | 10/1991 | Takashima . |
| 5,105,852 | 4/1992 | Wagner . |
| 5,168,843 | 12/1992 | Franks . |

*Primary Examiner*—Erick R. Solis
*Attorney, Agent, or Firm*—Nixon & Vanderhye, P.C.

[57] ABSTRACT

An exhaust valve assembly of an internal combustion engine selectively covers an exhaust manifold circumferentially located about a top wall of a cylinder without interfering with segments of a piston. The exhaust valve assembly includes a ring-shaped portion of a cylinder lining which is configured to selectively obstruct air from escaping radially from the top of the cylinder. An intake valve assembly is provided on a cylinder head and has a ring or washer shape. The timing of both valves is facilitated by a single spring and induction and exhaust gear-like planar timing bearings. The valving and timing arrangement facilitate the flexibility of the design of a combustion chamber.

12 Claims, 7 Drawing Sheets

29
29A
26
42
42
28
25
24
40
40
40
30
32
20
22
23

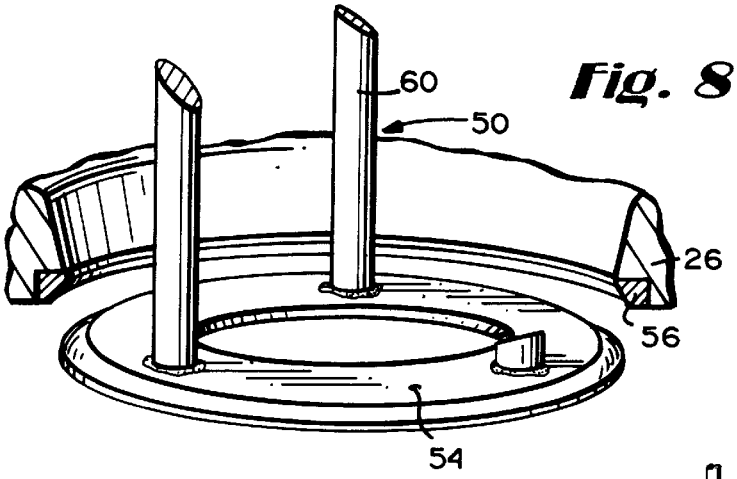
Fig. 8
Fig. 9
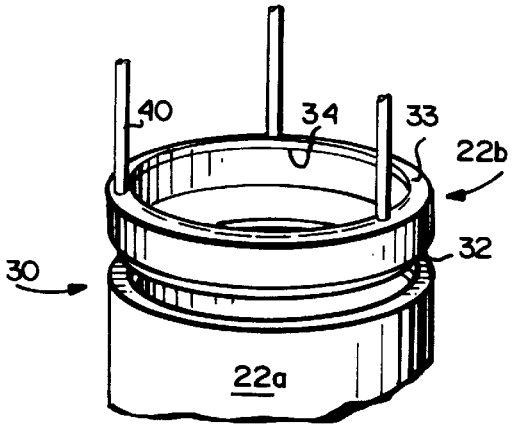
Fig. 10
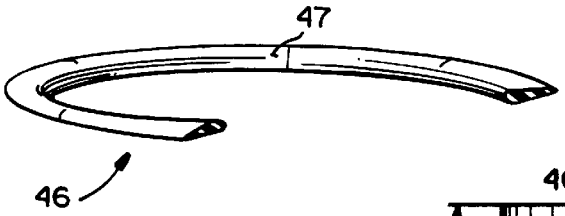
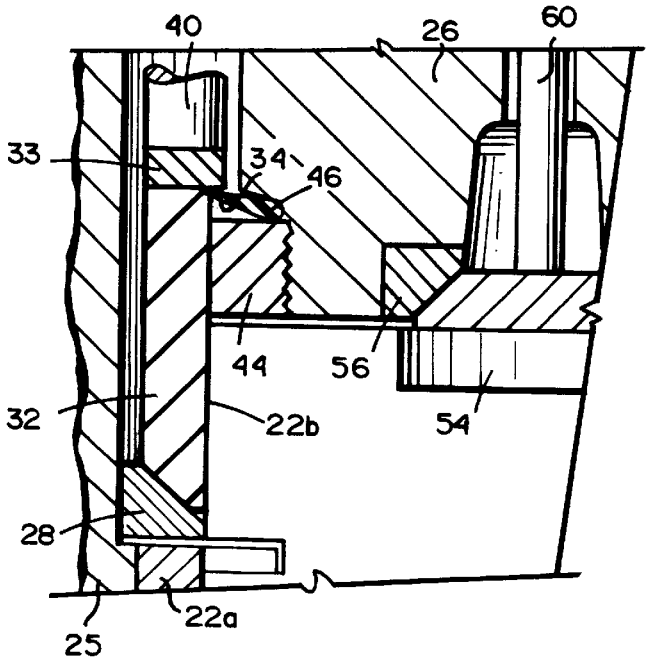
Fig. 11

VALVES AND VALVE TIMING FOR INTERNAL COMBUSTION ENGINE

BACKGROUND

1. Field of Invention

This invention pertains to valves and valve timing for a cylinder of an internal combustion engine.

2. Related Art and Other Considerations

Opening and closing of valve holes, as well as the sizes of valve holes, are important considerations in a four-stroke internal combustion engine.

Four valve heads are traditionally arranged with two suction or intake valves on one side of the head, and two exhaust valves on the other side of the head. There have been attempts to alter the placement of the valves, e.g., placing exhaust valves diagonally across from one another. These altered valve placement attempts appear to enhance volumetric efficiency, to lower interference, and to offer certain thermodynamic advantages.

It was generally believed that four valves in each cylinder would optimally assure maximum quantity of air intake. But recently some technicians have taken issue with the "nothing better than four" credo. For example, Yamaha developed a five-valve FZ 750 head. Alejandro De Tommaso developed a six valve head having three suction valves and three exhaust valves inside a 90 mm circumference.

With the conventional multiple valve arrangements very little of the valve head real estate is actually devoted to induction of combustible mixture, particularly since the valve head must also accommodate exhaust valves (and in a manner without interference). Moreover, the exhaust valves protrude into the cylinder and thereby have a tendency to oppose the outflowing of exhaust gases. Moreover, the exhaust valves (including the valve stems) are subjected to intense heat as the exhaust gas escapes.

There have been unsuccessful attempts (for example, the "Knight" engine) to eliminate valves on the cylinder head, for example by reciprocating sleeves up and down within a cylinder lining for the purpose of selectively opening and closing radial induction and exhaust ports.

Accordingly, it is an object of the present invention to provide a valving arrangement that enhances volumetric efficiency and improves fuel consumption in an internal combustion engine.

An advantage of the present invention is the provision of a variable and efficient timing system for operating the valving arrangement of the present invention.

SUMMARY

The invention pertains to a four stroke internal combustion engine, and provides a single induction valve and a single exhaust valve, each of which are two times bigger than the valves of a typical four valve cylinder. Also included is a timing system with only one spring and two bearing-like gears with caming lobes for actuating movement of the valves.

The exhaust valve is part of an exhaust valve assembly selectively covers an exhaust port circumferentially located about a top wall of a cylinder without interfering with segments of a piston. The exhaust valve assembly includes a ring-shaped portion of a cylinder lining which is configured to selectively obstruct air from escaping radially from the top of the cylinder. The exhaust port is opened and closed by the lifting of the exhaust valve assembly (30) by a vertical guillotine-type motion.

The induction valve is included in an intake valve assembly and is provided on a cylinder head. The intake valve assembly has a ring or washer shape. The ring shaped induction valve thus provides a single, large opening in a cylinder head for induction of a combustible mixture.

The timing of both valves is faciliated by a single spring and induction and exhaust gear-like, planar timing bearings. Each of the induction timing bearing and the exhaust timing bearing have a caming surface provided thereon to face the other bearing. The induction timing bearing and the exhaust timing bearing are followed by respective roller tappets. The valving and timing arrangement faciliate the flexibility in the design of a combustion chamber.

Thus, the dynamics of the induction and exhaust timing systems are inverted with respect to one another, but both systems share a common biasing spring and a common variable driving shaft.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 8 is a partial front view of an induction valve assembly according to an embodiment of the invention.

FIG. 9 is an isometric view of an exhaust valve assembly and a cylinder lining according to an embodiment of the invention.

FIG. 10 is a sectioned, isometric view of a seal included in an exhaust valve assembly of an embodiment of the invention.

FIG. 11 is an enlarged detailed sectioned view of a portion of the exhaust valve assembly of the embodiment of FIG. 1.

DETAILED DESCRIPTION OF THE DRAWINGS

Figure 1:
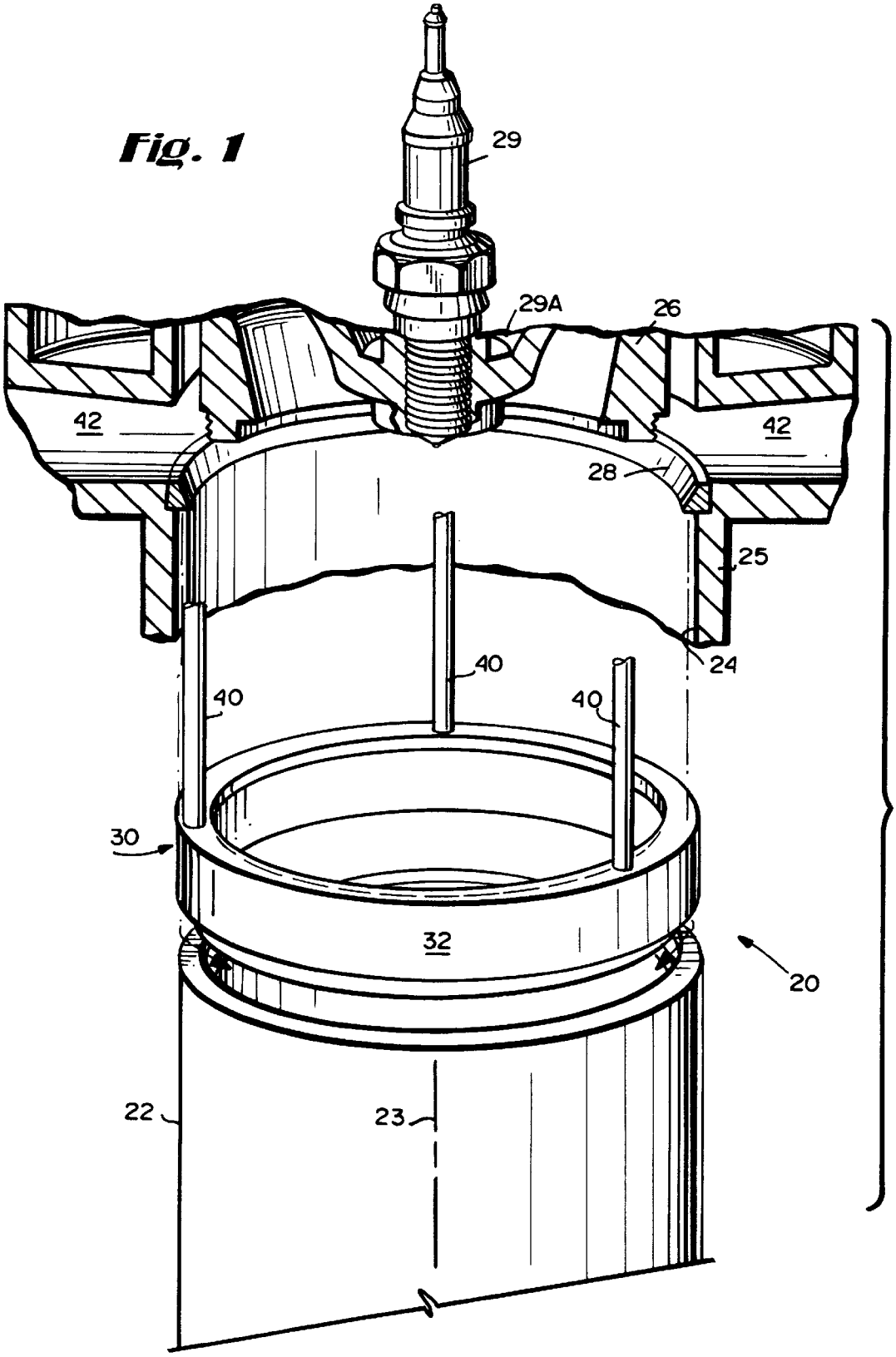
FIG. 1 is a partially sectioned, partially exploded front view of an exhaust valve assembly according to an embodiment of the invention.

FIG. 1 shows a cylinder assembly 20 for an internal combustion engine. The cylinder assembly 20 includes a cylinder lining 22 having a major cylindrical axis 23. Cylinder lining 22 is comprised of two segments—a lower lining segment 22*a* and an upper lining segment 22*b*. Cylinder lining segment 22*a* is accommodated in an appropriately sized hole 24 in an engine block 25. Cylinder lining segment 22*b* is discussed in greater detail hereinafter.

Engine block 25 has mated thereover an engine head 26. An upper inner peripheral edge of the hole 24 is peripherally recessed for receiving an annular seal 28. Annular seal 28 has a top interior surface which is beveled at an angle on the order of about 45 degrees (see FIG. 11). Annual seal 28 has a lower lip which protrudes into hole 24 and covers the axial top of cylinder lining segment 22*a*.

The cylinder lining 22 has a piston (unillustrated in FIG. 1, but illustrated as element 21 in FIGS. 2 and 3) reciprocating therein in customary fashion. An ignition plug 29 is threadingly received in plug channel 29A of head 26, centrally above the cylinder lining 22. A spark end of the plug 29 depends into an annular combustion chamber 21*a* provided between a squish band 21*b* of piston 21 (see FIGS. 2 and 3).

STRUCTURE: EXHAUST VALVE ASSEMBLY

As shown in FIGS. 1 and 9, cylinder assembly 20 further includes an exhaust valve assembly 30. Exhaust valve assembly 30 includes the cylinder lining segment 22*b,* also known as an exhaust valve ring member. As shown in more detail in FIG. 9, the exhaust valve ring member includes both a lower exhaust ring 32 and an upper exhaust ring 33. Both rings 32 and 33 are centered about axis 23. Lower ring 32 has inner and outer diameters substantially equal to the respective inner and outer diameters of the cylinder lining lower segment 22*a*. Upper ring segment 33 has a smaller inner diameter than the lower ring 32, thereby forming an overhanging ledge 34 which, as explained below, facilitates a sealing function.

In the illustrated embodiment, the upper exhaust ring segment 33 has three valve stems 40 formed (preferably soldered) on an axial end thereof. Valve stems 40 are provided at 120 degree angles about axis 23. It should be understood that fewer or more than the illustrated number of valve stems 40 can be employed in other embodiments.

As explained subsequently, exhaust valve assembly 30 reciprocates parallel to axis 23 (up and down in FIG. 1). During an exhaust stroke, lining segment 22*b* is lifted above seal 28, allowing exhaust gases to escape radially through exhaust channels or manifold 42 formed in engine block 25 and head 26. During other strokes, cylinder lining segment 22*b* sits tightly on seal 28, blocking exhaust manifold 42.

FIG. 11 shows in detail, among other things, the sealing of the exhaust valve assembly 30, including annular seal 28 mentioned before as fitting over the cylinder lining 22. In addition to annular seal 28, FIG. 11 shows an access ring 44 and a fishtailing seal 46.

Access ring 44 is threadingly fastened about the periphery of the cylinder head portion which is directly above the cylinder. Removal of access ring 44 faciliates engress and egress of the exhaust valve assembly 30 during fabrication and repair.

The seal 46, shown partially in cross section in FIG. 10, has an annular shape as seen from above but an lateral teardrop shape in cross section. The outer peripheral edge of seal 46 has a series of small radial cuts or notches 47, which enhances its elasticity. Seal 46, not being under high temperature, may be fabricated from normal steel.

The inner peripheral edge of seal 46 is positioned between access ring 44 and head 26 as shown in FIG. 11. The outer peripheral edge of seal 46 is vertically flexible but vertically limited by the ledge 44 provided on exhaust upper ring segment 33.

The shape of seal 46 assures an airtight closure variable in height, as it is not possible to have a precise connection between the head 26 and the rest of the block 25. When the connection of head and block is not perfect, the exhaust valve assembly 30 may be seated too high and (without the benefit of seal 46) gases may escape. But with the provision of the seal 46, the vertical amplitude of the segment flexures will be higher than the amplitude of the tolerance of combining head and block.

It is thus seen that the exhaust valve assembly 30 is provided only along the wall of the cylinder and on the highest part of the cylinder assembly 20. In this manner, the exhaust valve assembly 30 does not interfere with the surface that concerns the piston rings. By providing an exhaust valve assembly 30 that opens 360 degrees around axis 23, an exhaust area is provided with comparable area with a desirably large induction hole but without extending the exhaust area undesirably deeper into the cylinder (e.g., along the axis 23), and thereby increasing the likelihood of interfering with the piston and ring structure. In the illustrated embodiment, the cylinder assembly 20 has a bore of approximately 90 mm, but the fissure created by the opening of exhaust valve assembly 30 (projected on axis 23) is only about 10 mm.

It should be noted that the valve assembly 30 of the present invention overcomes a great disadvantage of prior art exhaust valves. Prior art exhaust valves open toward the inside of a cylinder and accordingly oppose the outflow of combustion gases and further heat the valve stem. In contrast, the exhaust valve assembly 30 of the present invention does not, when opened, protrude into the interior of the cylinder, and does not expose its valve stem to hot exhaust gases. Therefore, there is substantially less danger of preignition.

The exhaust valve assembly 30 of the present invention is well protected in its seat over the exhaust fissure, and accordingly is not significantly exposed to exhaust gases escaping from the cylinder assembly 20, nor does it obstruct flow of exhaust gases. Any heat that is absorbed by the exhaust valve assembly 30 is dissipated through stems 40 and its lower edge (which is near the cooling liquid).

Moreover, the exhaust valve assembly 30 of the present invention permits the entire exhaust manifold 42 to be opened so that the depression therein increases the effective volumentric efficiency of the cylinder during induction. Prior art valving arrangements employing exhaust valves on the cylinder head permitted only limited opening of the exhaust valves in view of the proximity of the piston. However, piston proximity is not a problem for the exhaust valve assembly 30 of the present invention. Accordingly, full opening of the exhaust manifold 42 provides a total suction substantially equivalent to increasing the suction created by the piston by about 1.5 times.

STRUCTURE: INDUCTION ASSEMBLY

Although unillustrated, cylinder assembly 20 of the embodiment of FIG. 1 has one or more induction valves provided above lining 22 and in head 26 around plug 29. The number and positioning of the induction valves is not critical for an understanding of the operation of the exhaust valve assembly 30 of the present invention. A currently preferred embodiment having one induction valve is illustrated, for example, in FIGS. 2 and 3.

Figure 2:
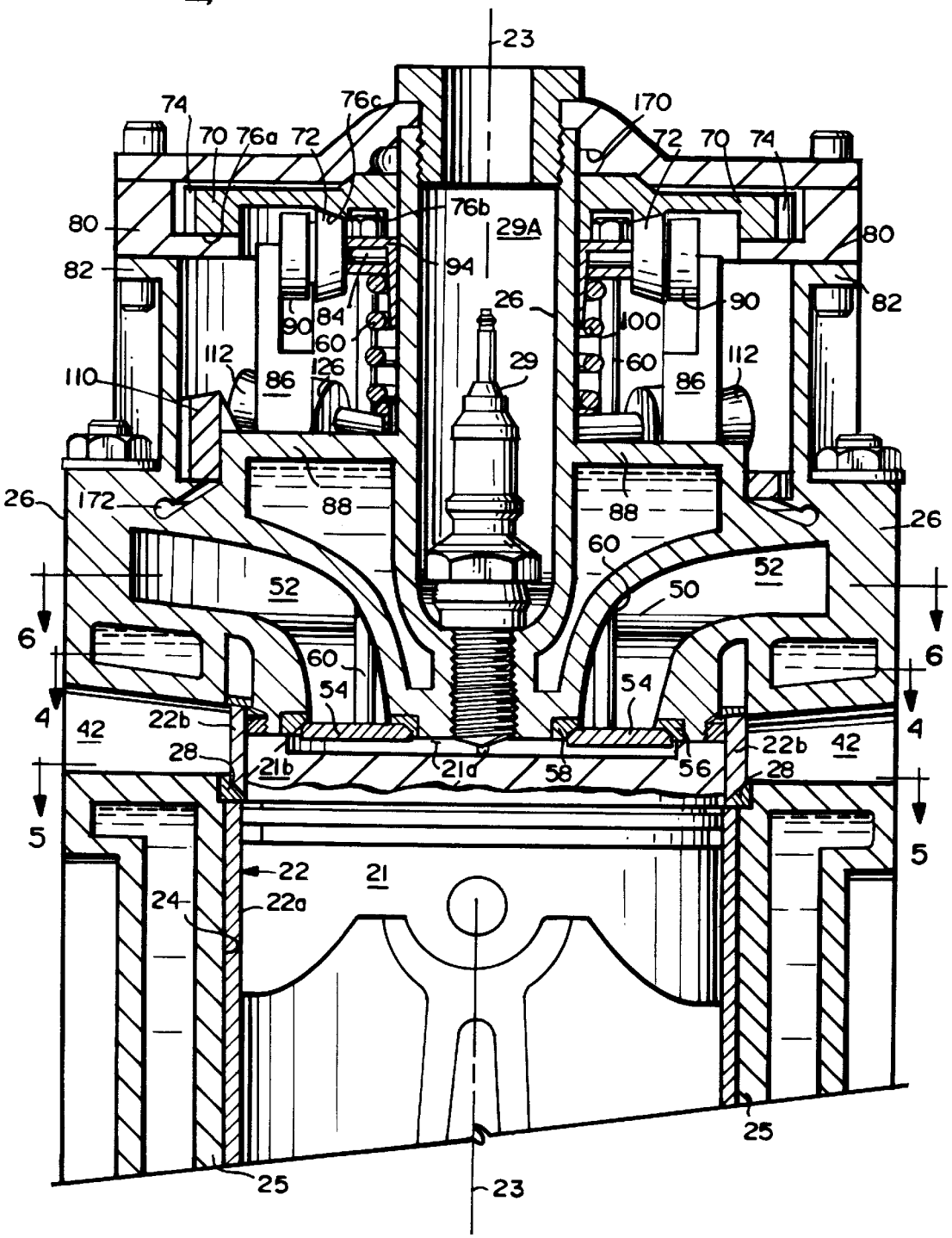
FIG. 2 is a sectioned front view of an internal combustion engine showing an exhaust valve assembly and a timing control system for use therewith in accordance with an embodiment of the invention.
Figure 3:
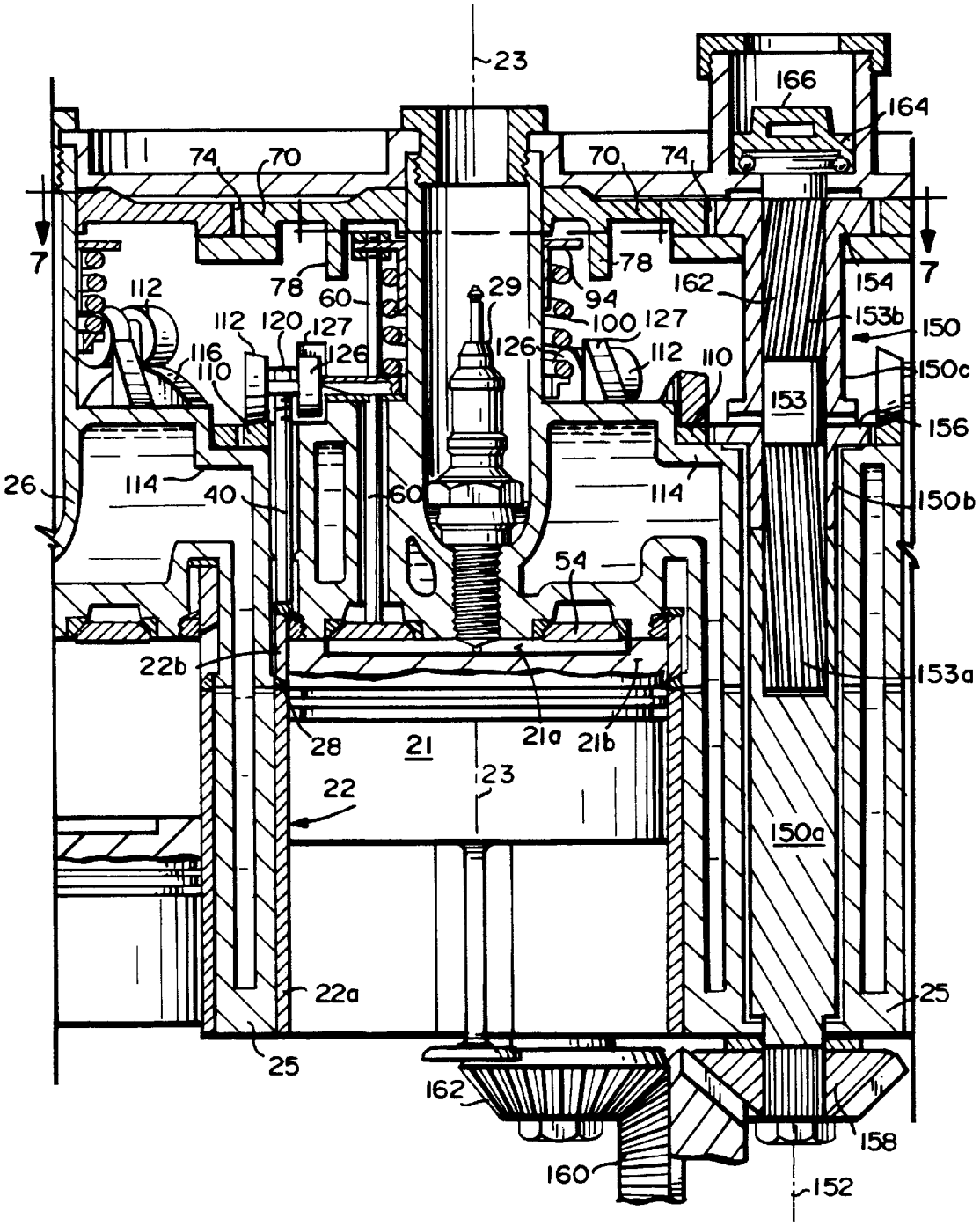
FIG. 3 is a sectioned side view of the engine of the embodiment of FIG. 2.
Figure 4:
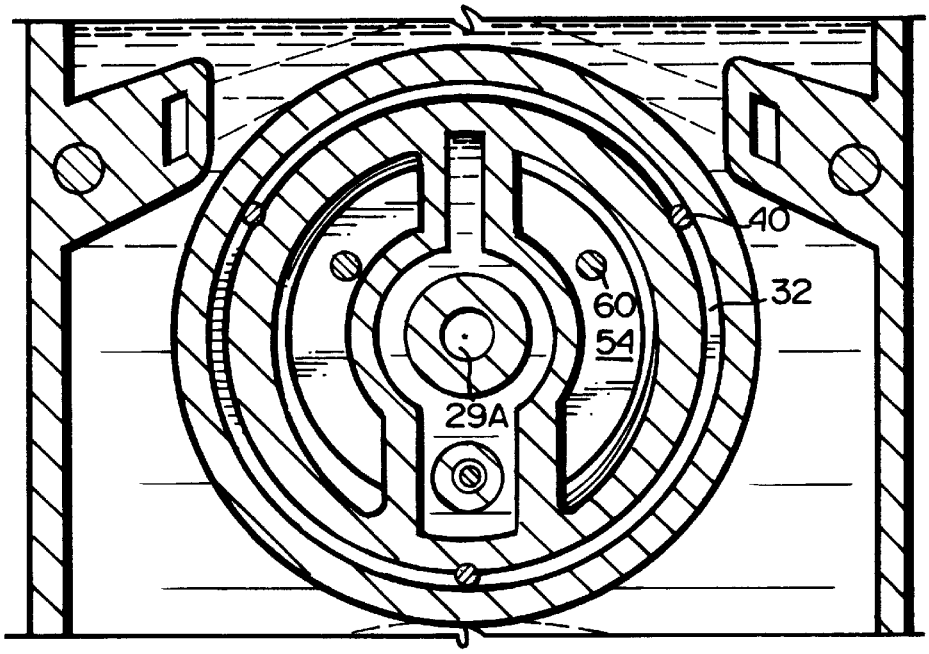
FIG. 4 is a sectioned view taken along line 4—4 of FIG. 2.
Figure 6:
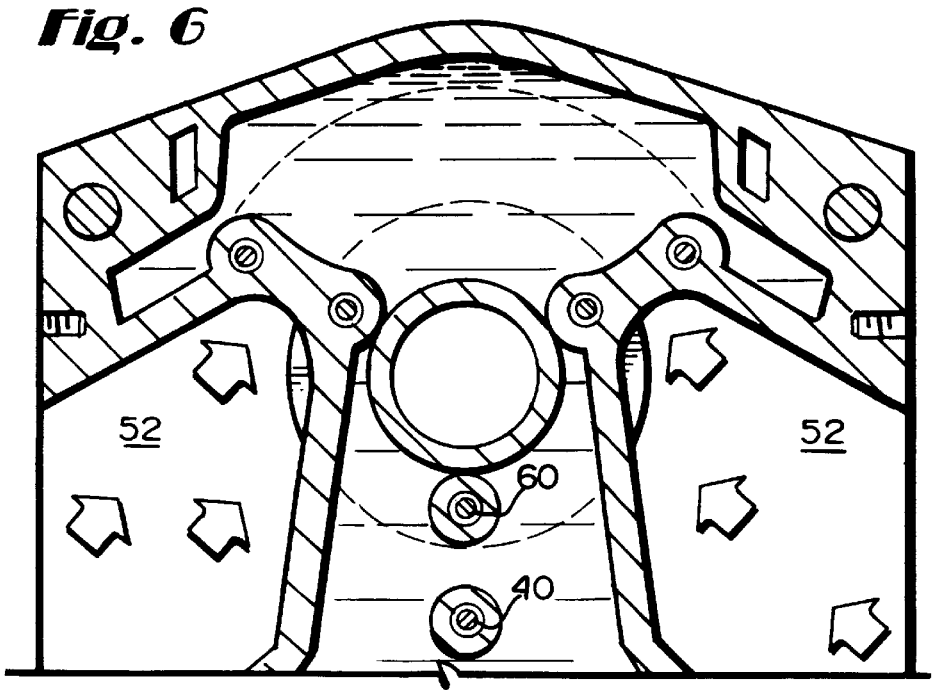
FIG. 6 is a sectioned view taken along line 6—6 of FIG. 2.
Figure 5:
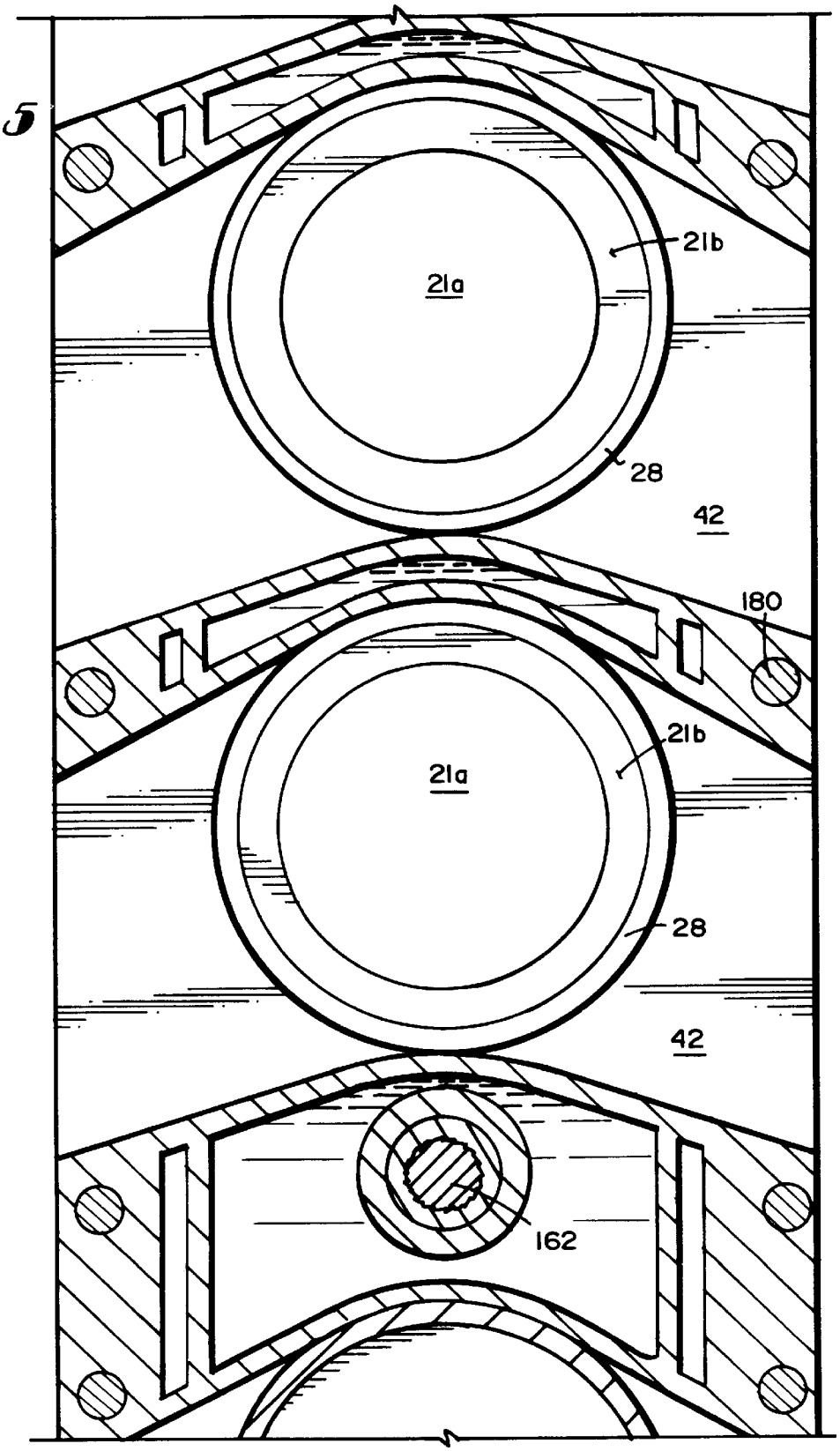
FIG. 5 is a sectioned view taken along line 5—5 of FIG. 2.
Figure 7:
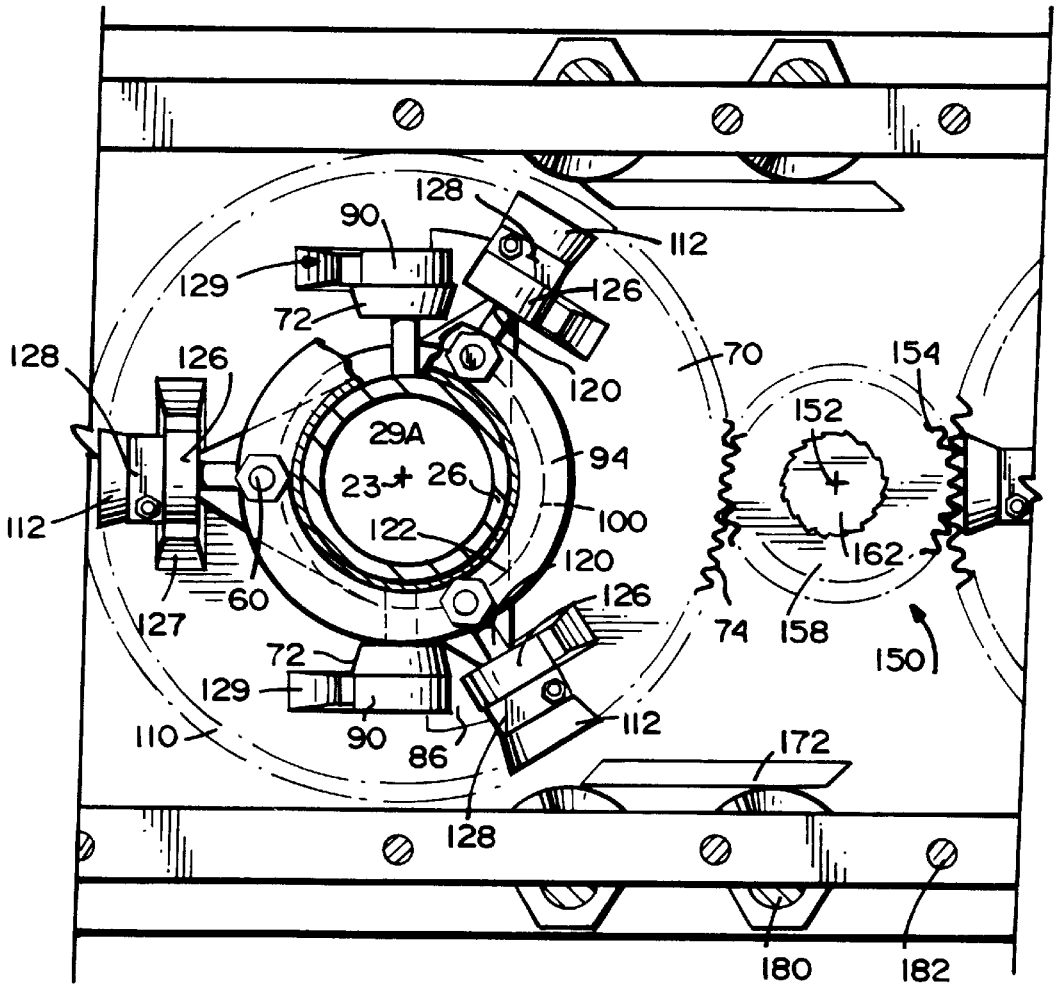
FIG. 7 is a sectioned view taken along line 7—7 of FIG. 3.

FIGS. 2–3 and 7 illustrate an embodiment of a timing system for controlling the operation of exhaust valve assembly 30 of FIG. 1. In addition, FIGS. 2 and 3 (as well as FIG. 8) illustrate an induction valve assembly 50 for introducing combustible gases into combustion chamber 21*a* through induction channels 52.

Induction valve assembly 50 includes a flat valve ring member 54 concentric about cylinder axis 23. Ring member 54 is thus also concentric with ignition plug 29. Ring member 54 has a surface area approximately equal to half the surface area of the roof of the cylinder. Advantageously, the single ring member 54 provides a passage area on the order of about twice as large as a conventional arrangement employing four valves, and approximately two and one half times as much passage area as a conventional two valve arrangement.

The top edges of ring member 54 are beveled for seating against annular seals 56, 58. Seal 56 is shown in FIG. 8; both seals 56 and 58 are shown in FIG. 2.

Induction valve ring member 50 has three stems 60 extending upwardly on an axial top surface of ring 50 (e.g., extending in a direction parallel to cylindrical axis 23). Induction valve stems 60 are positioned about axis 23 at 120 degree angular intervals, and are preferably soldered to the axial top surface of ring 50.

STRUCTURE: TIMING SYSTEM

The timing system of the embodiment of FIGS. 2, 3 and 7 includes both an induction timing sub-system and an exhaust timing sub-system. Induction timing sub-system includes an induction timing gear 70; two induction rollers 72; and, an induction timing linkage to which the tops of the induction valve stems 60 are connected.

Induction timing gear 70 is disk-shaped bearing (the terms "gear" and "bearing" being used interchangeably for this element) and lies in a plane perpendicular to cylinder axis 23. Gear 70 has its center on axis 23. Gear 70 is rotatable (via bearings or the like) about the head wall portion which forms plug channel 29A. Gear 70 has gear teeth 74 formed on its outer periphery.

On its axial underside surface 76, induction timing gear 70 has three annular surface segments, including inner surface segment 76*a;* outer surface segment 76*b;* and, intermediate surface segment 76*c* (see FIG. 2). Outer surface segment 76*b* rides on shoulders 80, which in turn rest on head support surfaces 82 (see FIG. 2). A portion of intermediate surface segment 76*c* forms an integral caming surface against which rollers 72 ride. The caming surface includes lobes 78 (see FIG. 3).

Induction rollers 72 are provided at 180 degree intervals about cylinder axis 23. Each of the two induction rollers 72 are concentrically mounted about a roller pin 84. A proximal end of each roller pin 84 is anchored in a roller post 86. Each roller post 86 is mounted on head support surface 88. A guide roller 90 is mounted intermediate roller post 86 and induction roller 72.

A distal end of each roller pin 84 is engaged by a reciprocating circular collar member 94. Collar 94 serves as part of the induction linkage. Collar 94 reciprocates about head wall 26 in a direction parallel to cylinder axis 23, and is concentric with cylinder axis 23. At its top collar 94 has the two corresponding roller pins 84 soldered or otherwise affixed thereto.

At three points, an underside surface of collar 94 has attached thereto, near its outer periphery, the upper ends of induction valve stems 60. The underside surface of collar 94, at a diameter intermediate those of the valve stems 60 and head wall 26, is fitted with a spring 100. Spring 100 is concentric with and extends around the portion of head wall 26 which forms plug channel 29A. A strength of spring 100 at rest on the order of 65 Kg. is sufficient to seal the exhaust valves. In the crossing lift existing between the exhaust valve and the suction valve, the spring 100 will never exceed the highest compression established, in which case one has to pay attention that the valves are both partially opened and the sum of the two lifts must be lower or equal to the maximum lift of each exhaust or suction valve.

The exhaust timing sub-system includes an exhaust timing gear 110 (see FIG. 3); three exhaust rollers 112; and, an exhaust timing linkage to which tops of exhaust valve stems 40 are connected. Exhaust timing gear 110 is a ring-shaped bearing (the terms "gear" and "bearing" being used interchangeably for this element), and lies in a plane perpendicular to cylinder axis 23. Gear 110 rotates (via interior peripheral bearings or the like) on support surface 114 provided by engine head 26. Gear 110 has gear teeth formed on its outer periphery. At its outer periphery, the upper surface of gear 110 provides a caming surface, having caming lobes such as lobes 116 provided thereon (see FIG. 3).

As shown in FIG. 3, exhaust rollers 112 ride on the caming surface provided by the outer periphery of the upper surface of gear 110. Each of the three exhaust rollers 112 is centrally and rotatably mounted on an outer end of a roller pin 120. An inner end of each roller pin 120 is anchored in a plate 122. A lower surface of plate 122 lies in a plane perpendicular to axis 23. Plate 122 has its outer edges shaped to form a triangle. Plate 122 is thicker towards its center, and has a central aperture (for fitting about the portion of head wall 26 which forms the plug channel 29A).

At its top inner edge, plate 122 supports spring 100, and many even have the bottom of spring 100 soldered or otherwise anchored thereagainst. The top of plate 122 may even have an annular groove for accommodating the bottom of the spring. Thus, after exhaust rollers 112 are lifted upwardly by lobes 116, spring 100 applies a return force to urge plate 122 and rollers 112 downwardly.

Intermediate the triangular plate 122 and each exhaust roller 112, each roller pin 120 carries a guide roller 126 and a clamp 128 (see FIGS. 3 and 7). Clamp 128 receives the upper end of a respective one of the exhaust valve stems 40 aligned therebeneath.

Guide rollers 126 are each confined by a pair of upstanding guide walls 127. As shown in FIG. 3, spacer guide walls have the shape of a right triangle. Guide rollers 90 for the induction rollers 70 likewise are confined by guide walls 129 (see FIG. 7).

FIG. 3 further shows means for driving the timing system. In particular, the driving means includes a driving shaft assembly 150 having a driving shaft axis 152. Driving shaft axis 152 is parallel to cylinder axis 23 but displaced to a side thereof. Driving shaft assembly 150 includes three driving shaft segments, particularly lower segment 150*a,* middle segment 150*b,* and upper segment 150*c.* Each segment has an axial bore for receiving a center spline 153. Spline 153 has two helically threaded segments, particularly spline segment 153*a* at its bottom and segment 153*b* at its top.

Driving shaft segment 150*b* includes a toothed gear 154 radially mounted thereon so that its peripheral teeth mesh with teeth 74 provided on induction gear 70. Similarly, driving shaft segment 150*c* includes a toothed gear 156 radially mounted thereon so that its peripheral teeth mesh with teeth provided on exhaust gear 110.

At its base, as seen in FIG. 3, driving shaft assembly 150 has a driving shaft gear 158 which meshes with a cross shaft gear 160. As also shown in FIG. 3, cross shaft gear 160 also meshes with a comparable driving shaft gear 162 for another side of head 26. *

At its top, driving shaft assembly 150 includes a ball bearing 164 having an engagement or connection handle 166. Handle 166 is mechanically linked to an unillustrated rotating drive actuator, which in turn is governed in accordance with motor RPM and other parameters. In accordance with sensed RPM and other parameters, the rotating drive actuator rotationally displaces the spline 153, thereby causing the spline 153 to adjust the positioning of the gears 154, 156 in accordance with all requirements. Adjustment of gears 154, 156 in turn performs an RPM-dependent adjustment for induction gear 70 and exhaust gear 110, respectively.

Head 26 is also provided with oil passageways 170 for the induction timing gear 70. Similarly, head 26 is provided with oil passageways 172 for the exhaust timing gear 110. These oil passageways are used only with the particular type bearing shown, but would not be used should roller bearings instead be employed.

Thus, it is seen that the timing system of the present invention comprises two gears 70, 110, both rotating about cylinder axis 23, but lying in spaced apart parallel planes (perpendicular to cylinder axis 23). Surfaces of the gears 70, 110 facing each other form caming surfaces operative for timing the opening and closing of valves. Both valve assemblies 30 and 50 move parallel, rather than at an angle to, cylinder axis 23.

It will be observed that FIG. 3 illustrates portions of a timing system for an adjacent cylinder assembly, it being well understood that the cylinders are laterally aligned in conventional manner and commonly driven by intermeshed gearing.

As seen in FIG. 7, screws 180 are provided for securing head 26 to block 25. Screw holes 182 are also provided for a cover to attach to head 26.

Although not specifically discussed therein, it will be further understood that the internal combustion engine of the present invention includes other conventional features well known by those skilled in the art. For example, engine block 25 and engine head 26 are provided with passageways for the circulation of a coolant fluid. Similar, the cylinder lining 22 has a piston reciprocating therein.

OPERATION: INDUCTION VALVE ASSEMBLY

In operation, it is understood that the induction valve assembly 50 is to be opened during an intake stroke of the engine; that the induction valve assembly 50 and the exhaust valve assembly are both to be closed during both the compression and combustion strokes of the engine; and, that the induction valve assembly 50 is to be closed And the exhaust valve assembly 30 opened during an exhaust stroke of the engine. As indicated above, the timing of the opening and closing of the induction valve assembly 50 and the exhaust valve assembly 30 is governed by the caming surfaces provided on the respective gears 70, 110, as more fully described below.

The timing of the actuation of the induction valve assembly 50 is governed by the caming surface provided in the inner surface segment 76*a* on the underside of induction timing gear 70. In particular, induction rollers 72 follow the caming surface on inner surface segment 76*a*. When the induction valve assembly 50 is to allow fluid communication between induction channel 52 and the interior of cylinder assembly 20 (i.e., during an intake stroke), lobes 78 on the caming surface on inner surface segment 76*a* cause induction rollers 72 to descend (i.e., travel in a direction parallel to axis 23 toward the cylinder assembly 20). Descent of the induction rollers 72 pushes down the circular collar member 94, which in turn pushes down the valve stems 60 and hence the flat valve ring member 54. Thus, the valve ring member 54 is unseated from seals 56, 58, allowing induction fluid to enter from induction channels 52 into combustion chamber 21*a*.

When the induction valve assembly 50 is to preclude fluid communication between induction channel 52 and combustion chamber 21*a* (e.g., during compression, and combustion strokes), the induction rollers 72 do not ride on the lobes, but rather on a flat portion of the inner surface segment 76*a*, thereby causing valve stems 60 to rise and valve ring member 54 to seat against seals 56, 58 in the manner shown in FIG. 2.

In analogous but inverted fashion, the timing of the actuation of the exhaust valve assembly 30 is governed by the caming surface provided on the outer periphery of the topside of exhaust timing gear 110. In particular, exhaust rollers 112 follow the periphery of gear 110. When the exhaust valve assembly 30 is to allow fluid communication between exhaust channel 52 and combustion chamber 21*a* (i.e., during an exhaust stroke), the lobes on the periphery of gear 110 exhaust rollers 112 to rise (i.e., travel in a direction parallel to axis 23 away from the cylinder assembly 20). The rise of the exhaust rollers 112 pulls up the exhaust linkage, which in pulls up the valve stems 40 and hence the cylinder lining segment 22*b*, causing the lining segment 22*b* to reciprocate away in guillotine fashion from the cylinder lining 22*a* and seal 28 fitted thereover. Thus, the cylinder lining segment 22*b* is unseated from seal 28, allowing exhaust fluid to escape radially at substantially 360 degrees from cylinder assembly 20 into exhaust manifold 42.

On the other hand, when the exhaust valve assembly 30 is to preclude fluid-communication between exhaust channel 52 and cylinder-assembly 20 (e.g., during compression and combustion strokes), the exhaust rollers 112 do not ride on the elevated lobes, but rather on a flat portion of the periphery of gear 110, thereby causing valve stems 40 to fall and cylinder lining segment 22*b* to seat against seal 28 in the manner shown in FIG. 3.

The exhaust valve ring member of the present invention has a height (projected on central axis 23) which is only about 11 mm, which is less than 50% of the cylinder stroke and preferably less than 20% of the cylinder stroke.

While the invention has been particularly shown and described with reference to the preferred embodiments thereof, it will be understood by those skilled in the art that various alterations in form and detail may be made therein without departing from the spirit and scope of the invention.

THE INDUCTION

As said before if you try to inscribe in a circle some identical circumferences, you will notice that with six circles you do not cover the major area. Inscribing four circles you can occupy a larger space, with five an even larger one.

Now, let's suppose that the exhaust of a cylinder could be carried out not through the head valves but in another way and through another place, to get the maximum passing area from the induction, we could use the exhaust lights too. With five valves we would have an excellent passing area, but because of problems due to sealing and fluidity of air intake, the opening of the valves must happen towards the inside of the cylinder and a very vast surface covered by the valves is not useful, because, part of the same surface, could represent an obstacle to the intake of air and petrol, the sum of all the valve areas cannot be higher than half the area of the cylinder roof top; otherwise If we occupy the other half the passing area will be reduced in a directly proportional manner.

On the above grounds, It is therefore superfluous to use four, five or oven six valves to cover a surface that can be easily obstructed by three valves. But even with three valves there remains the problem of the interference that occurs in those zones where the circumferences at the valves are tangent to themselves and to the cylinder wall, the best solution remains, then, that of the single central valve that has also the advantage of a considerably reduced surface of contact with the seat; in fact for a certain hole the overlapping edge of the valve represents a lost passage surface.

Adopting the solution of the single valve the problem of functionally fitting the ignition plug remains and, as it is not possible to obtain an adequate proximity for two plugs, the solution will be that of introducing significant changes to the big valve: a large hole will have to be made in the centre of the valve, than the stem will have to be eliminated and replaced by three having a smaller diameter, than they will be soldered to the valve around the hole for the plug. Also this new "ring-shaped" valve, will have to have a surface to close equal to half the area of the cylinder roof; it will be, then, possible to widen the external diameter in such a way as to increase the surface by an amount equal to the surface of the hole for the plug, through which the mixture will then be free to enter; in this case too the contact surface between the plug edge and the valve represents a lost surface to be added to the external one, but still measuring less than the three valves. Moreover, if the space around the plug does not allow enough width to permit the passage of water around the plus itself, it will then be possible to further wider, the "ring-shaped" valve (covering the same surface), as much as thought to be necessary. This special inlet valve so produced, creates a passage area twice as big if compared to the four valves and about two and a half times if compared to the classic two valves; the present abilities in constructing pieces of micromechanics can now reach such levels of infinitesimal tolerance as to make it possible for the two edges of the valve, the interior and the exterior one to fit in their respective seats without mutual interferences; the seats will then consist of the usual material.

We can now proceed to examine how the exhaust should be made in order to make the above-mentioned induction feasible to all intents and purposes.

THE EXHAUST

A first consideration comes natural: from where should the exhaust gases come out, if the hole head is occupied by the induction?

Coherently to the philosophy of the project, to such a generous induction must correspond a really free exhaust with an adequately vast surface of the hole.

By exclusion, the opening for the exhaust gases can be found only along the wall of the cylinder and on the highest part of the chamber in order not to interfere with the surface that concerns the piston rings, they have, therefore to be under the exhaust hole. If we want to give the exhaust hole an area proportional to the induction hole, we find some problems: the dimension of one or more side windows would be, indeed, notable in height and would impose the use of a piston with rings at the base of the skirt. That would not be functional; we would have, then, problems with the sealing of the valves, as it would be necessary to open towards the outside and to drive radial valves is a mess.

The solution is to make only one hole of limited height but which turns all around the highest part of the cylinder: in this way, we can obtain an area of passage actually equal to the induction one, with a fissure of only 11 mm, if the cylinder has the considerable bore of 100 mm. The rings can have, in this way, a natural position finding their spline 10 mm or even less under the top of the piston (according to the compression ratio, the shape of the chamber and the squish band). In order to open and close, the chamber, the hole has a special valve, obviously cylindric, (table 6) that moves up and down like a guillotine from the head to the chamber and viceversa.

What follows needs our particular attention. The sealing of the valves must be assured at the top with an edge of the valve, folded inwards, which rests on an edge made in the head, where a particular segment guarantees the necessary sealing, thanks to its shape and vertical elasticity.

To make this piece it will be necessary to choose a kind of material which preserves its elastic properties at fairly high temperatures; even though it is protected inside by the edge of the head, it could be reached by burning gases. As you can see in the FIG. 3, Table 6 the shape has to assure for the valve an airtight closure variable in height, as it is not impossible for it to have a precise connection between the head and he rest of the block, being the valves part of the head. Therefore, if the connection is not perfect, the valve will be higher than it should be on the upper seat, and will be no longer sealed, in the case in which the head is too lifted from the rest of the engine, we can have an escape from the lower part of the valve, that will not be able to close the whole spline, as it will have already knocked against its upper seat.

With the above-mentioned segment, we can obviate difficulties like these, considering that the vertical amplitude of the segment flexures will be higher than the amplitude of the tolerance of the combining of the bead and block. These tolerance is even greater in the case of multi-cylindric heads. In any case the segment is required to make oscillations that are not very tall and it has to bear a small mechanical effort and so, it can have a limited thickness, which, with small appropriate cuts around the external circumference, could have the required elasticity without having to apply to it weight superior to 5 Kg. The lower part of the valve does not present any particular problem for airtight closure, since it may be considered as a big valve with the diameter equal to the cylinder. Therefore a joining will be created which is similar to that one of traditional valves with an inclination of the edge of contact of 30–45 degrees to the axis of the valve.

The pressing down of the valve will be assured by a spring of a special distribution, as will be seen later. A strength for the spring at rest of 65 Kg will be sufficient (less than the two exhaust springs of a Fiat Fire 1000) to make it possible to overcome the internal pressures of the cylinder which tends to escape.

In fact, we can establish that the sealing surface in a 100 mm cylinder is given by 31;4 mm per 0;400, 0:040 being a normal tolerance of joining between cylinder and piston and between valve and head; because of this we have an area subject to the sealing which will approximately be equal to 31;4 mm; now, considering a point of maximum internal pressure of 200 Kg per cm (Honda RA 168 turbo, one of the most powerful has a limit of 167 Kg per cm), in extreme cases the strength of sealing is surely minor than 50 Kg as opposed to the 65 Kg of the spring, which wastes other 5 Kg to push the elastic segment down.

Of course, the surface of contact between valve and pipe will be covered with material similar to that of traditional valve seats. In the same way, the upper point of contact of the valve on the segment will be protected. As has already been said, there is no need for the lifts to be higher than 11 mm, cams of distribution will have normal and already ested dimensions. The common exhaust valves have a very great disadvantage, that of opening towards the inside of the cylinder, opposing the normal outflow of the exhaust gases which after having overcome them, continue to eat the stem too. The temperatures reached, are very high in comparison to the suction-valves.

(FIG. 7)

We are obliged to use more resistent and expensive materials (chromium-plate steel, silicon steel, actinium with a high percentage of nickel chromium). Often, one is obliged to make complicated pieces such as hollow valves or partiallly filled with metallic sodium or lithium or potassium' salts which improve heat transmission from the head to the stem. All these problems do not affect the new system for the expulsion of gases.

Actually, for the greater part of gas elimination time, "the guillotine" valve is well protected in its seat over the exhaust fissure. It is, therefore, not exposed to exhaust gases and it does not obstruct their flow. Any heat that it could absorb, when it is closed, would be easily absorbed by the stems and the lower edge that is near the cooling liquid, as happens with the piston. Besides the function of supporting distribution, also the task of sending exhaust gases towards the two sides of the block and then to their respective exhaust manifolds is left to the separating walls (strong and well-cooled) between the cylinders. In this way the entry and exit of gas is facilitated.

Some limitations are due to the position of the stems, but we can obviate this by inclining the separation walls of the cylinders, as is shown in table 4.

THE VALVES TIMING CONTROL

On the top of the three stems of the intake valve, we fix the upper supporting bass of the spring, better still if counter balanced and of considerable dimensions, inside which there is an alluminium cylinder where the plug can be inserted. The spring is inside the three stems and has as lower supporting base, a small bowl of appropriate shape which lies on the head; the opening of the valve occurs when the upper supporting base is pushed down.

For correct and precise movement, it is necessary to have two points where pressure should be applied, contemporaneously, in the opposite margins of the circular base. There, it is useful to apply roller tappets on which the low of lifting is imposed by means of the rotation of a thrust ball bearing, belonging to the head cover and that presents (on its lower side and directly in contact with the rollers) two backs which, during every revolution, push the tappets with proper acceleration and deceleration.

The backs, in fact, are nothing else but the eccentrics of normal cams flat developed on the plane of the lower part of the bearing that is dented externally and that receives movement from the driving shaft through gearings. In the same way, It is engaged with the teeth of the bearings of the intake valves of chambers which might possibly be contiguous.

For dimension and rotation speed (equal to half a turn of the driving shaft) of the bearing, the development of a very long cam is possible. A glass inside the spring which runs outside the cylinder containing the plug, will prevent undesiderable oscillations of the stems of the valve. In the same way, the exhaust valve is controlled by three backs of a bearing which lies on the head and encloses the stems of the valve externally. The backs act, this time on three rollers rather than two, because of the vaster perimetrical size. Rollers are fixed with a foot on the stems of "the guillotine" when the backs operate on rollers (and they act simultaneously), moving them up, the whole valve is lifted, it opens in this way the exhaust circular fissure; the three stems fixed on the edge of the valve push down the valve, instead, when it is necessary for it to be closed. This happens because the three stems belong to the small lower supporting bowl of the spring of the intake valve which, being partially at rest, during the exhaust phase, can be used even for the exhaust valve. In the crossing lift existing between the exhaust valve and the suction valve, the spring will never exceed the highest compression established by the project, in which one has to pay attention that the valves are both partially opened and the sum of the two lifts must be lower or equal to the maximum lift of each exhaust or suction valve.

For the exhaust too, we can use lifting laws with very strong accelerations, thanks to roller tappets which can normally support doubled weights and thanks to very small climbing angles.

This is possible because of the notable dimension of the bearing, as has been already explained. It will then be useful to apply some rollers, driven by small suitable, to the six arms which connect the stems of both valves to the small supporting bowl for the spring. This is to avoid undesiderable torsions of the stems when the backs attack the roller tappets.

As the stems of both valves are shorter and thinner than usual and as a single spring, even though thicker, has been used, we can rightly hope to obtain small weight, thanks to the mechanics of distribution which adopt neither arms nor balance. But the large size of valves does not make it possible, in my opinion, to save greatly on the weight. This is the reason why an accurate plan of lifting laws must be studied which, even though they are helped, as already mentioned, by the roller tappets and by the very small climbing angles, must, however, take into consideration the possibility of a rotation speed faster than normal. In fact a propeller made in this way can reach a rotation speed unthinkable till to now, because limited mostly by passive resistances more than pumping ones. Consequently, even the spring becomes important; the choice of number and section of its coils must be carefully considered so as not to have breaks due to resonance. It is possible to assure the lubrication of the distribution and of the thrust bearings in particular, arranging some canalizations which join in the supporting seats of the various thrust bearings. So, the oil fall from upper bearings will assure roller lubrication. On each side of every lower bearing will be created two connections to the lower base in order to eliminate adequately the exceeding oil, otherwise emulsified by the gears of the bearings. The connections between the head and the basement, of course, pass through the separation walls of the various cylinders.

FINAL CONSIDERATIONS

Maybe easier from competition engines but also in propellers without variable inductions it is useful to adopts this kind of distribution for its particular prerogative: in fact the possibility of keeping completely opened the exhaust valve, even when the piston is at its T.D.C. gives the opportunity to use the depression which is in the exhaust pipe to increase filling; in other words, a kind of overfeeding engine without the disadvantages of excessive gas consumption, weight increments and complications typical of a turbo compressor. We can count on the most complete espulsion of the residual combustion products which are followed by an air mass that had not to stagnate in the intake manifold and have a lower temperature to advantage the volumetrical output and the chamber temperatures that (together with the thermic advantages of "the guillotine") give the possibility to use larger pistons which give almost quadratic power increments. Adding all thees thing to what I said about the reduction of pumping friction (that has much more importance than the passive friction, specially at high speed), it seems right to expect a considerable increment of torque and power.

If a very little extension of the block for arranging various bearings of the distribution is accepted and if an accurate planning of the big springs and of the cams is realized in order to eliminate noise and vibrations and reach high speeds, a perfectly flat combustion-chamber can be achieved together with notable squish band for a better swirll. (De Tomaso, even though he had the problem of cooling the head, showed the importance of that with his six valves.)

So in engine projects designed for an economic aim, we can be sure to obtain interesting savings and pollution reduction. Another interesting advantage is the possibility to easly realize (Table 2) a variable law of the time lifting of the valves so as to increase torque at the different speeds.

It is possible also to adopt a double turbine for the four cylinders, as was done for FIAT Triflux.

We can have fluid exhaust (greater efficiency for a turbo engine); we can use a lighter cooling system; the head height and breadth much reduced, to the advantage of the barycentre and weight. We can employ two injectors per cylinder instead of only one, for a better spryng; we can have the elimination of possible crush of the exhaust valve on the piston. We can inspect again the chamber through the exhaust fissures without opening the head. Today the new tecnologies are the only way to survive in this sector. Over all the actual possibility that C.A.D. C.A.M. computers give us in terms of quickly projecting engines should incorage furtherly that the write step to do is to build this engine.

The embodiments of the invention in which an exclusive property or privilege is claimed are defined as follows:

1. A valve timing system for controlling the actuation of an exhaust valve and an induction valve with respect to a combustion chamber of an internal combustion engine, the timing system comprising:

an induction timing gear and an exhaust timing gear, the induction timing gear and the exhaust timing gear being rotatable about an axis parallel to a central axis of the combustion chamber, the induction timing gear and the exhaust timing gear lying in spaced apart parallel planes perpendicular to the central axis of the combustion cylinder, each of the induction timing gear and the exhaust timing gear having a caming surface provided thereon to face the other gear, the caming surface of the induction timing gear being operative to control the actuation of the induction valve and the caming surface of the exhaust timing gear being operative to control the actuation of the exhaust valve.

2. The apparatus of claim 1, wherein the valve timing system further comprises at least one induction roller and one exhaust roller, the induction roller following the caming surface of the induction timing gear and the exhaust roller following the caming surface of the exhaust timing gear, the induction roller being connected to the induction valve through an induction linkage and the exhaust roller being connected to the exhaust valve through an exhaust linkage.

3. The apparatus of claim 2, wherein the exhaust valve comprises a ring shaped member for selectively closing an exhaust channel from the combustion chamber, the ring shaped member having at least one stem thereon through which reciprocating motion is transmitted via the exhaust linkage to the ring shaped member for reciprocating the ring shaped member in a direction parallel to a central axis of the combustion chamber and thereby selectively communicating the exhaust channel and the combustion chamber.

4. The apparatus of claim 2, wherein the induction valve comprises a ring shaped member for selectively closing an induction channel from the combustion chamber, the ring shaped member having at least one stem thereon through which reciprocating motion is transmitted via the induction linkage to the ring shaped member for reciprocating the ring shaped member in a direction parallel to a central axis of the combustion chamber and thereby selectively communicating the induction channel and the combustion chamber.

5. A valve assembly for use with a combustion cylinder in an internal combustion engine, comprising an exhaust valve and an induction valve, one of said valves being formed by a ring member reciprocated along a longitudinal axis of the combustion cylinder for selectively opening and closing a fluid communication between a fluid channel and a combustion chamber defined in the combustion cylinder and closed by a cylinder head, a plurality of ring driving stems extending from said ring member in a direction parallel to the longitudinal axis of the combustion cylinder and being circumferentially spaced about said longitudinal axis, and sealing means cooperating with said ring member, wherein the improvement comprises said fluid channel extending radially from said cylinder head and said ring member is shaped and arranged as a cylindrical moveable axial extension of said combustion cylinder and is slidingly movable inside the cylinder head between a channel closing position in which said ring member sealingly engages an end portion of the combustion cylinder and a channel opening position in which said ring member is axially moved at a distance from said end portion of the combustion cylinder.

6. A valve assembly according to claim 5, wherein said fluid channel is a gas exhaust channel and said ring member is an exhaust valve for opening and closing said exhaust channel.

7. A valve assembly for use with a combustion cylinder in an internal combustion engine, comprising an exhaust valve and an induction valve, one of said valves being formed by a ring member reciprocated along a longitudinal axis of the combustion cylinder for selectively opening and closing a fluid communication between a fluid channel and a combustion chamber defined in the combustion cylinder and closed by a cylinder head, a plurality of ring driving stems extending from said ring member in a direction parallel to the longitudinal axis of the combustion cylinder and being circumferentially spaced about said longitudinal axis, and sealing means cooperating with said ring member, wherein the improvement comprises said fluid channel extending radially from said cylinder head and said ring member is shaped and arranged as a cylindrical moveable axial extension of said combustion cylinder and is slidingly movable inside the cylinder head between a channel closing position in which said ring member sealingly engages an end portion of the combustion cylinder and a channel opening position in which said ring member is axially moved at a distance from said end portion of the combustion cylinder, wherein the sealing means comprises an annular seal fixedly engaged with said end portion of the combustion cylinder and provided with an inclined wall for engagement with the ring member and a fishtail-shaped seal arranged in an annular recess of the cylinder head and having an outer peripheral edge elastically urged in sealing engagement with an internal wall portion of the ring member.

8. A valve assembly according to claim 7, wherein said fluid channel is a gas exhaust channel and said ring member is an exhaust valve for opening and closing said exhaust channel.

9. A valve assembly according to claim 8, further comprising an induction valve formed by a flat valve ring shaped member for selectively opening and closing a fluid communication between an induction channel and the combustion chamber, said ring shaped member having at least one stem thereon through which reciprocating motion is transmitted to the ring shaped member for reciprocating the ring shaped member in a direction parallel to the longitudinal axis of the combustion cylinder and thereby selectively communicating the induction channel and the combustion chamber.

10. A valve assembly for use with a combustion cylinder in an internal combustion engine, comprising an exhaust valve and an induction valve, one of said valves being formed by a ring member reciprocated along a longitudinal axis of the combustion cylinder for selectively opening and closing a fluid communication between a fluid channel and a combustion chamber defined in the combustion cylinder and closed by a cylinder head, a plurality of ring driving stems extending from said ring member in a direction parallel to the longitudinal axis of the combustion cylinder and being circumferentially spaced about said longitudinal axis, and sealing means cooperating with said ring member, wherein the improvement comprises said fluid channel extending radially from said cylinder head and said ring member is shaped and arranged as a cylindrical moveable axial extension of said combustion cylinder and is slidingly movable inside the cylinder head between a channel closing position in which said ring member sealingly engages an end portion of the combustion cylinder and a channel opening position in which said ring member is axially moved at a distance from said end portion of the combustion cylinder, wherein said fluid channel is a gas exhaust channel and said ring member is an exhaust valve for opening and closing said exhaust channel, and further comprising an induction valve formed by a flat valve ring shaped member for selectively opening and closing a fluid communication between an induction channel and the combustion chamber, said ring shaped member having at least one stem thereon through which reciprocating motion is transmitted to the ring shaped member for reciprocating the ring shaped member in a direction parallel to the longitudinal axis of the combustion cylinder and thereby selectively communicating the induction channel and the combustion chamber.

11. A valve assembly for use with a combustion cylinder in an internal combustion engine, comprising an exhaust valve and an induction valve, one of said valves being formed by a ring member reciprocated along a longitudinal axis of the combustion cylinder for selectively opening and closing a fluid communication between a fluid channel and a combustion chamber defined in the combustion cylinder and closed by a cylinder head, a plurality of ring driving stems extending from said ring member in a direction parallel to the longitudinal axis of the combustion cylinder and being circumferentially spaced about said longitudinal axis, and sealing means cooperating with said ring member, wherein the improvement comprises said fluid channel extending radially from said cylinder head and said ring member is shaped and arranged as a cylindrical moveable axial extension of said combustion cylinder and is slidingly movable inside the cylinder head between a channel closing position in which said ring member sealingly engages an end portion of the combustion cylinder and a channel opening position in which said ring member is axially moved at a distance from said end portion of the combustion cylinder, and further comprising a valve timing system for controlling the actuation of the exhaust valve and the induction valve, wherein said valve timing system comprises an induction timing gear and an exhaust timing gear which are rotatable about an axis parallel to the longitudinal axis of the combustion cylinder, the induction timing gear and the exhaust timing gear lying in spaced apart parallel planes perpendicular to said longitudinal axis of the combustion cylinder and each of the induction timing gear and the exhaust timing gear having a caming surface provided thereon to face the other gear, the caming surface of the induction timing gear being operative to control the actuation of the induction valve and the caming surface of the exhaust timing gear being operative to control the actuation of the exhaust valve.

12. A valve assembly according to claim 11, wherein said valve timing system further comprises at least one induction roller and at least one exhaust roller, the induction roller following the caming surface of the induction timing gear and the exhaust roller following the caming surface of the exhaust timing gear, the induction roller being connected to the induction valve through an induction linkage and the exhaust roller being connected to the exhaust valve through an exhaust linkage.

* * * * *